US006019095A

United States Patent [19]

Sommer et al.

[11] Patent Number: 6,019,095

[45] Date of Patent: Feb. 1, 2000

[54] METHOD AND A DEVICE FOR THROWING BALLS

[75] Inventors: Klaus Sommer, Pittsburgh, Pa.; John Clemons, Mount Pleasant, S.C.; Wolfgang Jacobsen; Ing Kurt Pirk, both of Koln, Germany; Arthur Zerbe, Burscheid, Germany; Werner Konig, Leverkusen, Germany; Berthold Justen, Burscheid, Germany; Jurgen Giesselmann, Overath, Germany; William Wasserberger, Spring Lake; Raymond Edwards, Grand Rapids, both of Mich.

[73] Assignees: Bayer Aktiengesellschaft, Leverkusen, Germany; Bayer Corporation, Pittsburgh, Pa.; Brunswick Corporation, Muskegon, Mich.

[21] Appl. No.: 09/088,224

[22] Filed: Jun. 1, 1998

[51] Int. Cl.[7] ..... A63D 5/00; A63F 7/28

[52] U.S. Cl. ..... 124/4; 124/6; 273/129 Q; 273/129 W; 473/107

[58] Field of Search ..... 124/4, 6, 36; 273/129 Q, 273/129 V, 129 W; 473/107

[56] References Cited

U.S. PATENT DOCUMENTS

| | | | |
|---|---|---|---|
| 1,273,301 | 7/1918 | Wood | 124/6 |
| 2,206,213 | 7/1940 | Weidemann | 124/4 X |
| 2,280,331 | 4/1942 | Whittle | 124/4 X |
| 2,490,802 | 12/1949 | Hanff | 124/4 X |
| 2,610,618 | 9/1952 | Huber | 473/107 X |
| 3,142,292 | 7/1964 | Suchland | 473/107 X |
| 3,364,787 | 1/1968 | Miller | 473/107 X |

FOREIGN PATENT DOCUMENTS

| | | | |
|---|---|---|---|
| 93/00138 | 1/1993 | WIPO | 124/6 |

OTHER PUBLICATIONS

John C. Falconi, "Striking at the Core of Bowling Balls", Mechanical Engineering, Aug. 1993 pp. 44–48.

*Primary Examiner*—John A. Ricci
*Attorney, Agent, or Firm*—Joseph C. Gil; Noland J. Cheung

[57] ABSTRACT

The invention relates to a method and a device for throwing balls with specific throwing parameters with the aid of a pendulum. The device consists of a pendulum having a free end which is suspended so as to be movable about an axis, characterized in that a holding device for the ball is located at the free end of the pendulum shaft and can release the ball in response to an electrical signal.

18 Claims, 4 Drawing Sheets

METHOD AND A DEVICE FOR THROWING BALLS

FIELD OF THE INVENTION

The present invention relates to a method and a device for throwing balls using specific throwing parameters, with the aid of a pendulum.

BACKGROUND OF THE INVENTION

The method and device for throwing balls, in particular bowling balls, can be used for testing balls, for example, in relation to their properties during flight, impact and rolling. In relation to the throwing of bowling balls, lane materials or pins can be tested, in addition, to the balls.

In John G. Falcioni, "Striking at the Core of Bowling Balls", *Mechanical Engineering*, August 1993, pp. 44–48, an automatic ball thrower is mentioned at the bottom of the lefthand column on page 47, which sets bowling balls in a sliding motion at a lateral velocity of at least 6.4 m/sec. The acceleration of the balls is obtained by a large pressure cylinder.

The problem on which the present invention is based is that of simulating the throw of a ball, in particular, a bowling ball, by a person in a manner which is as true to reality as possible.

SUMMARY OF THE INVENTION

The invention relates to a method and a device for throwing balls with specific throwing parameters with the aid of a pendulum. The device consists of a pendulum having a free end which is suspended so as to be movable about an axis, characterized in that a holding device for the ball is located at the free end of the pendulum shaft and can release the ball in response to an electrical signal.

DETAILED DESCRIPTION OF THE INVENTION

The throw of a ball by a person can be defined by a small number of parameters. In the following, "balls" are understood to mean all types of spherical bodies.

In order to describe the movement of the balls, a Cartesian system of coordinates with axes defined as x, y and z is used. The axes x and y span the plane of constant gravitational potential. Parameters for defining a throw (FIG. 1) are the direction of throw v, the height of release h and the speed of the throw |v| of the ball. The velocity component $v_x$ of the ball in a preferred direction x such as, for example, in the direction of a bowling lane is defined as the lateral velocity. The direction of throw can be defined by the angle of throw $\alpha$, in relation to the x direction in the x-y plane and by the angle of throw $\beta$, in a plane vertical to the x-y plane.

Figure 1:
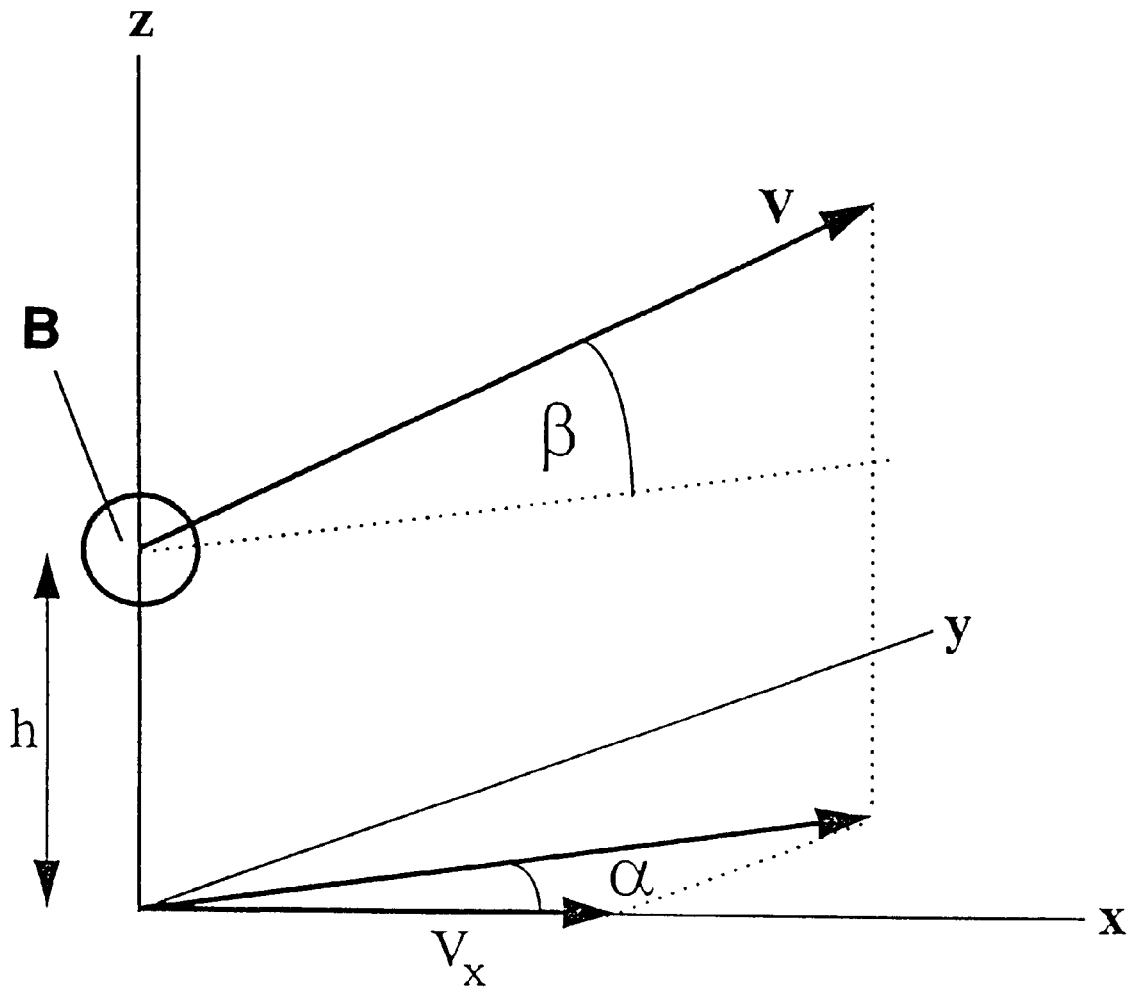
FIG. 1 shows the parameters of a throw.

As shown in FIG. 1, the parameters of a throw are illustrated. The ball B moves from its height of release h over the plane spanned by the x axis and the y axis (the x-y plane) in direction v at a speed of |v|. Direction v is at an angle $\beta$ to the x-y plane and an angle $\alpha$ to the x direction in the x-y plane. The term $v_x$ is the component of v in the x direction and defines the lateral velocity.

Figure 2:
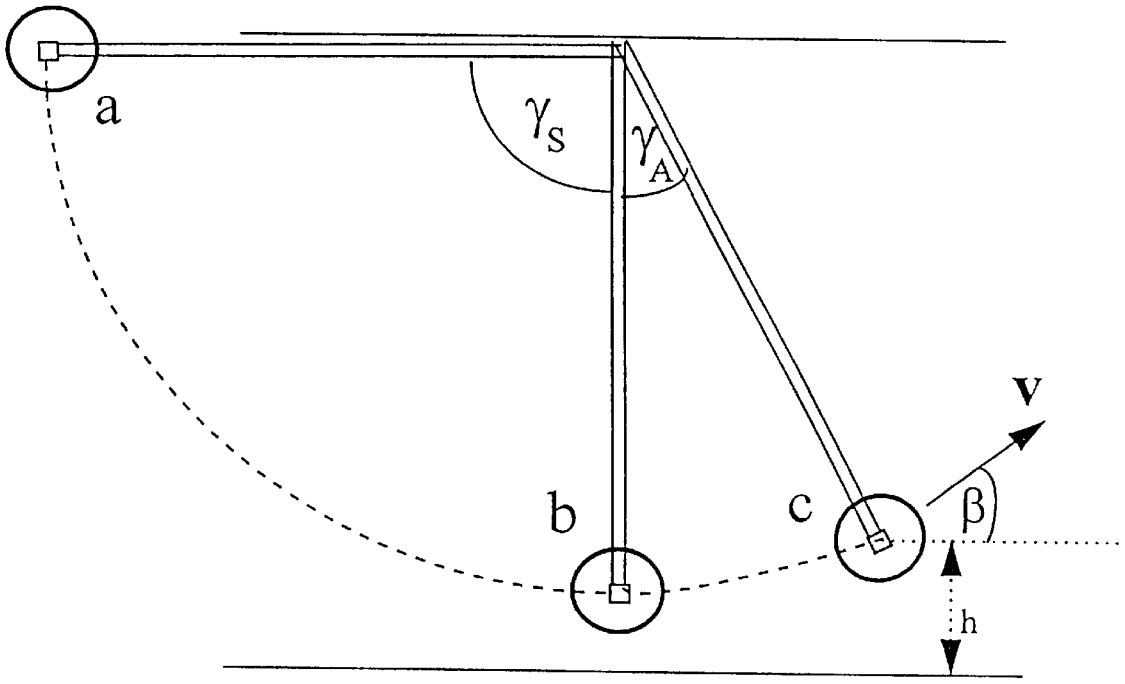
FIG. 2 is a diagram of a pendulum with a ball attached thereto.

In the process according to the present invention, the realistic simulation of the human throw is obtained by means of a pendulum, in which a ball is attached to the free end of the pendulum. The pendulum is raised to the "starting position" $\gamma_S$, which is at a predetermined degree of deflection from the point of equilibrium. From this position, the pendulum swings freely back to the position of equilibrium and beyond the latter to the point of reversal $-\gamma_S$, unless additional forces come into effect. During this swing of the pendulum, the ball is released from its attachment as the pendulum swings through a specific predetermined angular position, i.e. the "release position" $\gamma_A$ (FIG. 2).

Prior to its passage through the equilibrium position, the swing phase of the pendulum is referred to as the acceleration phase and the swing phase after its passage through the equilibrium position is referred to as the retardation phase. Preferably, and in particular, when bowling balls are thrown, the ball is released from its attachment at a degree of deflection of $-10° \leqq \gamma_A \leqq +10°$, and preferably $\gamma_A = 0°$.

As the ball is released, the lateral velocity $v_x$ of the ball is calculated, in the case of $\alpha = 0°$, from the starting position of the pendulum, i.e. the release position, the mass distribution over the pendulum shaft and the length of the pendulum. The length of the pendulum is understood to be the distance between the rotating axis of the pendulum shaft and the central point of the attached ball.

When the ball-holding device is released as the pendulum swings through the position of equilibrium, a maximum ball velocity of $v_{max}$ is obtained at the selected starting position. Preferably, the angle of deflection chosen for the starting position is $\gamma_S = 90°$. Ideally, the largest proportion of the mass over the pendulum shaft is concentrated at the free end. Thus, the following equation applies to an ideal pendulum:

$$v^{max} = \sqrt{2 \cdot g \cdot L}$$

wherein L denotes the length of the pendulum and g denotes the acceleration due to gravity.

The angle of throw $\beta$ in the plane vertical to the x-y plane is identical to the release position $\gamma_A$. When $\beta = 0°$, the ball is released as it passes through the position of equilibrium. When $\beta$ 0°, the release position is not the position of equilibrium.

The angle of throw $\alpha$ can be adjusted by distorting the plane of oscillation of the pendulum over the x-y plane. The height of the release of the ball can be adjusted by changing the length of the pendulum.

The lateral velocity obtainable for a given pendulum length during free oscillation can be increased by springs which connect the pendulum to a body which is non-movable in relation to the pendulum. Such a spring is stressed when the pendulum is deflected into the starting position, so that it stores mechanical energy. During the acceleration phase of the pendulum, the spring transfers this mechanical energy completely or partially to the shaft of the pendulum and thereby, increases its speed.

The springs can be arranged in such a manner that their resting position corresponds to the resting position of the pendulum. Then, during the retardation phase of the pendulum, the springs are stressed once again and promote the retardation of the pendulum. In this symmetrical arrangement, the starting position and the point of reversal are at identical degrees of deflection on both sides of the resting position.

Alternatively, the springs can be arranged in such a manner that their resting position does not correspond to the resting position of the pendulum. The springs then already retard the movement of the pendulum while it is still in the acceleration phase and before it reaches the resting position, or continue to accelerate the movement of the pendulum in the retardation phase after the pendulum has passed through its resting position. This depends on the relationship between the resting position of the springs and the resting position of the pendulum.

By selecting a specific number and strength of the springs, the quantity of stored energy and thus, the degree of acceleration or retardation can be predetermined.

It may be advantageous to modify the movement of the shaft of the pendulum by means of a braking device, which is activated over a portion of the oscillating phase, for example, during the acceleration phase prior to the release of the ball, in order to obtain speeds at the point of release which are lower than the speed provided by the length of the pendulum, the release position and the geometry of the pendulum during free oscillation. The braking device can also be used for rapidly retarding the shaft of the pendulum after the ball has been released.

It is also advantageous when simulating the throw of a human being for the ball to undergo self-rotation on being released. In the method according to the present invention this self-rotation of the ball is produced by the ball being set in rotation about an arbitrary axis of rotation prior to its release, by means of a rotation mechanism arranged in the holding device of the pendulum.

The device for throwing balls consists of a suspending apparatus which is non-movable in relation to the pendulum and from which a pendulum shaft is suspended so as to be movable about an axis, i.e. the axis of rotation. A device for holding the ball is arranged at the free end of the pendulum shaft. The holding device for the ball can release the ball preferably, in response to an electrical signal.

The holding device consists preferably of two mutually opposed holding brackets. At least one, and preferably both, of the holding brackets are radially displaceable along a straight line through the center of the ball. The ball is held by being clamped between the two holding brackets, whereby at least one of the brackets is moved manually or pneumatically or electrically along the straight line through the center of the ball in the direction of the ball. The ball is correspondingly released by at least one of the brackets being moved in the opposite direction.

Preferably, the length of the pendulum can be varied from between a length at which the attached ball touches the underlying surface in the position of equilibrium and a length at which the center of the ball in the position of equilibrium is located at a distance of three ball diameters from the underlying surface. For this purpose, the pendulum, preferably, consists of two parts, one which is firmly connected to the suspending apparatus for the pendulum and the other which is firmly connected to the holding device for the ball. These two parts are displaceable in relation to one another and determine the length of the pendulum. Most preferably, both parts consist of rods of an identical profile, one of which is hollow and has inner dimensions which are somewhat larger than the outer dimensions of the second rod, so that the latter can be pushed into the former.

The pendulum can be attached to a body which is non-movable in relation to the pendulum, via one or more springs, such as, for example, elongation or torsion springs, in such a manner that, when the pendulum is in its resting position, the springs are also in their resting position. When the pendulum is deflected, the springs are stressed. The pendulum can also be attached to one or more springs in such a manner that the springs are deflected in the resting position of the pendulum and reach their resting position at a certain degree of deflection of the pendulum.

The pendulum can be advantageously fitted with a brake. Preferably, this is in the form of a rotational brake fitted to the axis of rotation of the pendulum shaft. The most preferred type of brake is a rotary brake with pneumatically movable brake blocks, which act via mechanical friction. The braking torque is predetermined by an electrical control signal. Preferred braking devices are those which continuously change their braking action in response to a continuous control signal, most preferably, in such a manner that the braking effect is almost zero at the lower limit of the control signal and is of such strength at the upper limit that the arrest of the pendulum shaft during its rotating motion by means of full braking occurs after an angular variation of less than 45° after the start of the braking process.

The holding device for the ball can contain a rotating mechanism for the ball. This mechanism is preferably an electric motor. It can be connected to an electrical measuring system for the speed of rotation. In order to allow the axis of rotation to be oriented in any desired direction in space, the holding device must be capable of being rotated about two axes which are vertical to each other. Preferably, one of these rotating axes lies parallel to the longitudinal direction of the pendulum and the second vertically thereto. Fixing devices prevent the adjusted axis from changing during the movement of the pendulum.

If the holding device for the ball consists of two mutually opposed holding brackets, these can be fitted so as to be rotatable and can transmit the rotation of a rotation drive to the ball.

The sequential control of the throwing device is preferably carried out by an electronic controlling and regulating system.

According to the present invention, the present method renders it possible to throw balls under reproducible, adjustable and realistic conditions or to lower bowling balls onto a bowling lane. In particular, it is possible to adjust the lateral velocity and the self-rotation of the ball to values occurring in practice. The additional spring devices for providing additional acceleration have the advantage that the structural height of the device can be reduced compared with a freely oscillating pendulum. The incorporation of a braking device has the advantage that, after the release of a ball, the pendulum shaft can be brought to rest more quickly than with a freely oscillating pendulum and the time required for the ball-throwing experiments can be thereby reduced. If the acceleration phase cannot be triggered from various angular positions of the pendulum shaft, the braking device also has the advantage that lower lateral velocities can be adjusted than those corresponding to the length of the pendulum. Partial braking during the acceleration phase (pre-braking) allows the lateral velocity to be finely adjusted in a simple manner and without any mechanical adjusting operations.

FIG. 2 illustrates a diagram of a pendulum with a ball attached to its free end, in three different positions a, b and c. The position a is the starting position at a degree of deflection of $\gamma_S$; the position b is the position of equilibrium; and the position c is the release position $\gamma_A$. In the release position, the pendulum is deflected from the position of equilibrium by the angle $\gamma_A$. The angle $\beta$ is identical to the angle $\gamma_A$. The ball is at a release height h and has a speed of |v| in direction v.

Figure 3:
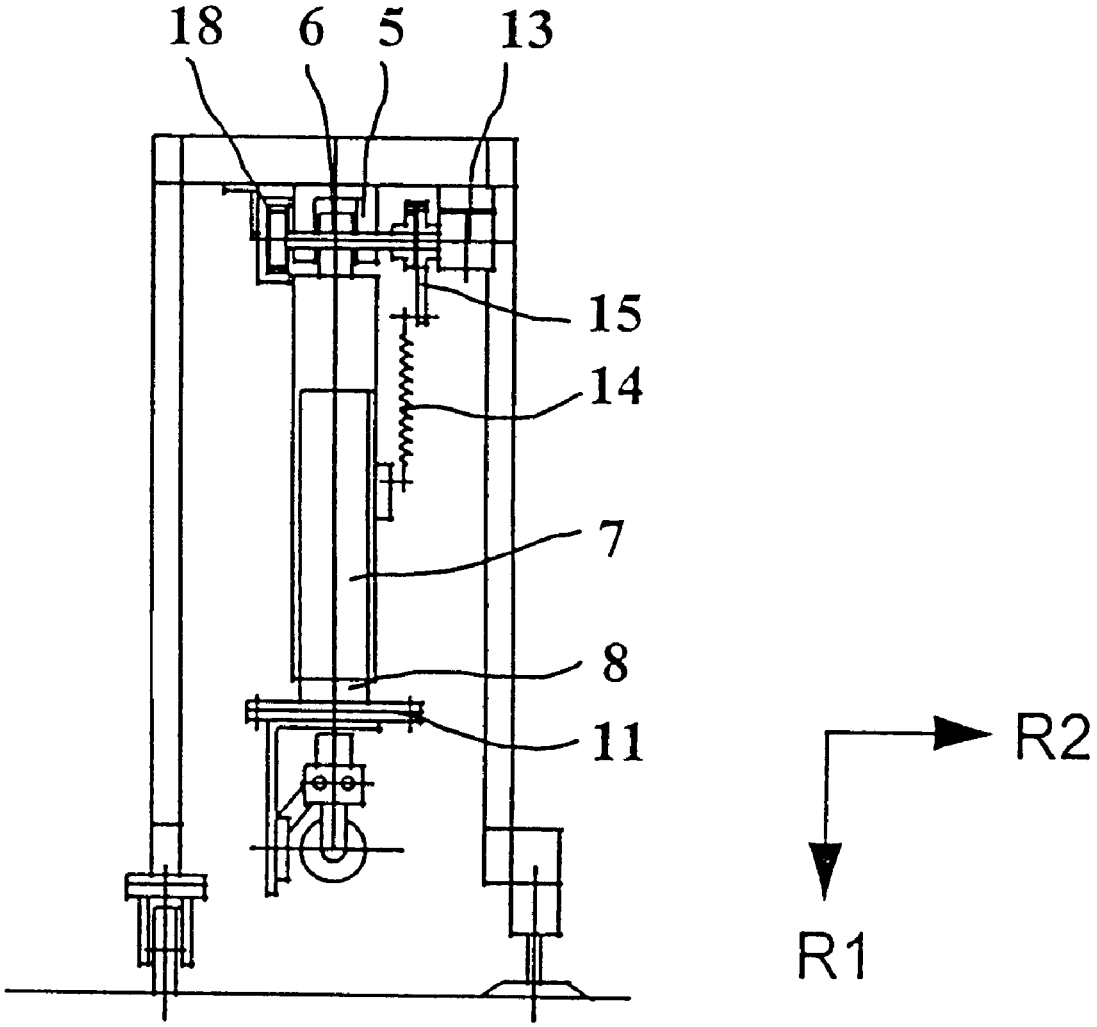
FIG. 3 shows a view of a device of the present invention for throwing bowling balls in the plane of oscillation of the pendulum.
Figure 4:
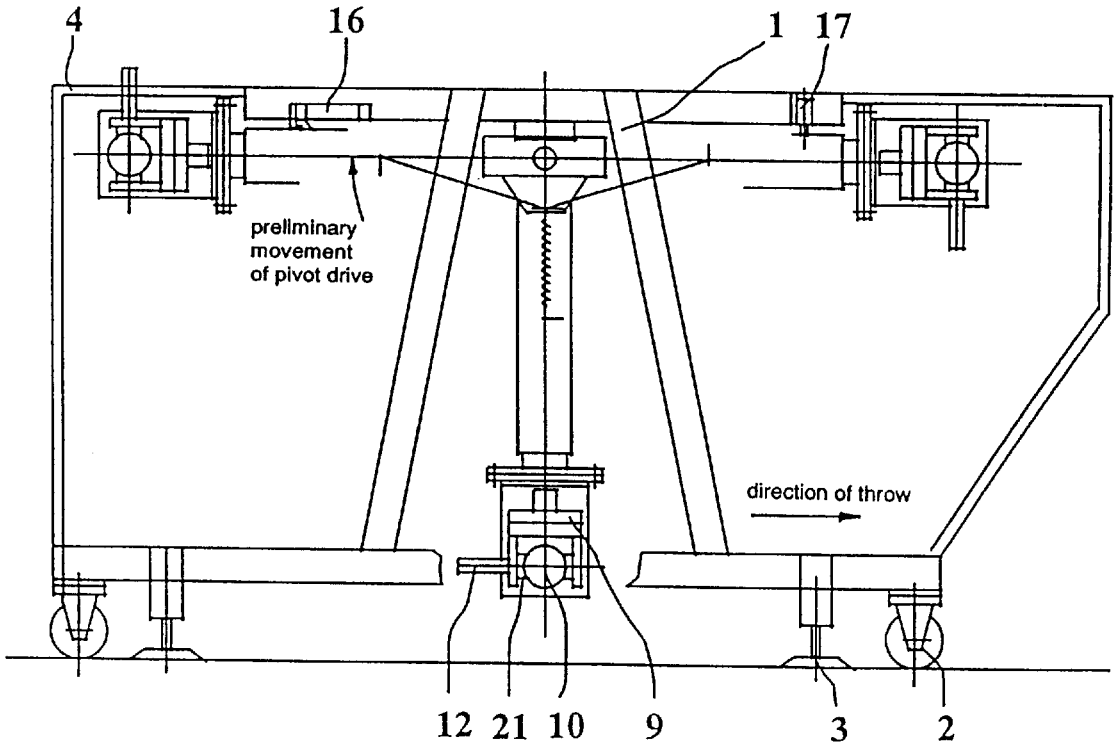
FIG. 4 shows a side view of the device of the present invention for throwing bowling balls vertical to the plane of oscillation of the pendulum.

As shown in FIGS. 3 and 4, the supporting apparatus for the throwing device is a steel frame structure 1 welded together in the form of a box section. It stands on four (4) wheels 2, which allow the device to be moved along the bowling lane without any major exertion of force. One depressible vacuum suction stub 3 is fitted next to each of these four (4) wheels for arresting the throwing device on the lane. As soon as these suction stubs rest on the lane and a vacuum has been applied, the device can no longer be moved.

For reasons of safety, the entire space reachable by the pendulum during its oscillation is shielded by a transparent cover 4.

A bearing bracket 5, which holds the rotating axis 6 of the pendulum shaft, is attached to the top panel of the frame. The pendulum shaft consists of two tubes 7 and 8 which are slotted into each other and are movable in relation to each other.

The ball holder 9 which holds the ball 10 to be thrown is fitted to adjusting device 11 which allows the rotation or tilt of the ball-holding device about two axes R1 and R2 which are vertical to each other. The first axis R1 is parallel to the longitudinal direction of the pendulum. The second axis R2 is vertical to the first axis.

The holding brackets 21 of the ball holder are mounted in ball bearings in a readily movable manner and are actuated by an electric motor 12 with an integrated tacho-generator for measuring the speed of rotation.

In order to adjust the release height, the inner tube 8 of the pendulum is pushed into the outer tube 7 to a greater or lesser extent with the aid of two spindle rods.

The movement of the pendulum shaft is brought about by a hydraulic pivot drive 13. The spring acceleration device 14 can hold up to five elongation springs. One of the ends of this spring device is fitted approximately to the middle of the pendulum shaft. The other end is fitted to a cam plate 15 which is coupled to the pivot drive via a carrier in such a manner that during the preliminary movement of the pivot drive, only the pendulum is raised to a horizontal position. In this position, it is held by an electromechanically controlled clamp 16. During the backward movement of the pivot drive, the spring assembly is stressed.

In order to trigger the pendulum, the clamp 16 is disengaged and the pendulum oscillates through the position of equilibrium assisted by the spring device. Without any additional steps, the point of reversal would occur precisely in the opposite horizontal position. As a precaution, a pneumatic shock absorber 17 is located at this point.

A pneumatic brake 18 is also fitted to the axis of the pendulum. It is triggered immediately after the pendulum oscillates through the position of equilibrium and arrests the pendulum in the braking phase after a degree of deflection of less than 45°.

Given a pendulum length of 2.4 m, this embodiment of the throwing device achieves throwing speeds of 4.5 to 9.4 m/sec. In relation to the resting position of the pendulum, the rotation of the ball-holding device about axis R1 allows the horizontal adjustment of the axis of rotation of the ball in any desired direction. By tilting the ball-holding device about axis R2, the axis of rotation can additionally be varied from the horizontal by an angle of between 60° in the upward direction and 30° in the downward direction.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. A method of throwing balls with a predetermined initial speed, a predetermined direction of throw and a predetermined height of throw, characterized in that the required acceleration and direction of movement of the ball is obtained by means of a pendulum on a throwing device, comprising the following steps:

a) attaching the ball to the free end of the pendulum, b) deflecting the pendulum to a predetermined angular position, c) swinging the pendulum backwards, and d) releasing the ball as the pendulum swings through a predetermined angular position through an electronic signal;

wherein said throwing device comprises a plurality of wheels which can be moved along a surface and the sequential control of said throwing device is controlled by an electronic controlling device.

2. A method according to claim 1, characterized in that the backward oscillation of the pendulum is accelerated and/or retarded by at least one spring.

3. A method according to claim 1, characterized in that the backward oscillation of the pendulum is retarded by means of a brake which is activated over part of the acceleration phase and/or the retardation phase of the pendulum.

4. A method according to claim 1, characterized in that the ball is caused to self-rotate before being released.

5. A method according to claim 1, characterized in that the ball is released in the acceleration phase or in the retardation phase at the degree of deflection of from −10° to 10° from the position of equilibrium.

6. A method according to claim 5, characterized in that the ball is released in the acceleration phase or in the retardation phase at the position of equilibrium.

7. A method according to claim 1, wherein said ball is a bowling ball.

8. A device for throwing balls comprising a frame, a pendulum having a shaft with one end mounted to the frame for movement about an axis and having a free end which is suspended, characterized in that a holding device for the ball is located at the free end of the pendulum shaft and can release the ball in response to an electrical signal as the free end of the pendulum swings through an arc, said device comprising plurality of wheels attached to the frame which can be moved along the surface to facilitate transport of the device.

9. A device for throwing balls according to claim 8, characterized in that the holding device consists of two mutually opposed holding brackets, at least one and preferably both of which can be moved radially along a straight line through the center of the ball.

10. A device according to claim 8, characterized in that one or more springs are attached to the pendulum and to a body which is non-movable in relation to the pendulum.

11. A device according to claim 10, characterized in that the spring(s) is/are attached in such a manner that the resting position of the pendulum corresponds to the resting position of the springs.

12. A device according to claim 8, characterized in that a rotary brake is located on the rotating axis of the pendulum.

13. A device according to claim 12, characterized in that the rotary brake changes its braking effect continuously in response to a continuous control signal.

14. A device according to claim 8, characterized in that the holding device for the ball contains a rotation mechanism which can cause the ball to self-rotate.

15. A device according to claim 8, characterized in that the holding device for the ball is formed by two mutually opposed holding brackets which are mounted in a rotatable manner and can be set in rotation by a rotation drive.

16. A device according to claim 8, characterized in that the holding device for the ball is fitted to an adjusting device which enables the holding device to be rotated about two axes which are perpendicular to each other.

17. A device according to claim 8, characterized in that the pendulum consists of two sections over its length, one of which is firmly connected to the suspending apparatus for the pendulum, whereas the second section is firmly fixed to the holding device and the two sections can be moved in relation to each other to such an extent that the length of the pendulum at which the ball touches the underlying surface in its resting position can be shortened by up to 3 ball diameters.

18. A device according to claim 8, wherein said ball is a bowling ball.

* * * * *